United States Patent [19]

McCown et al.

[11] 4,136,676

[45] Jan. 30, 1979

[54] FLUE BOX ASSEMBLY

[75] Inventors: Letcher I. McCown, Bolingbrook; Ernest H. Soderlund, Oak Lawn, both of Ill.

[73] Assignee: Thermiser Manufacturing Corporation, Oak Lawn, Ill.

[21] Appl. No.: 858,370

[22] Filed: Dec. 7, 1977

[51] Int. Cl.[2] ..... F23L 11/00; F23L 13/00

[52] U.S. Cl. ..... 126/292; 98/78; 236/49

[58] Field of Search ..... 126/285 R, 292, 293; 98/79; 236/49

[56] References Cited

U.S. PATENT DOCUMENTS

| | | | |
|---|---|---|---|
| 526,828 | 10/1894 | Bell | 126/285 R |
| 1,196,117 | 8/1916 | Kiefer | 126/285 R |
| 1,580,106 | 4/1926 | Allie | 126/292 |
| 1,901,821 | 3/1933 | Provincial | 126/285 R |
| 1,957,197 | 5/1934 | Bridge | 126/285 R |
| 2,117,672 | 5/1938 | Linhard | 126/285 R |
| 2,222,663 | 11/1940 | Handley | 126/292 |
| 2,371,677 | 3/1945 | Crooker | 126/293 |
| 3,912,223 | 10/1975 | Iwata | 126/293 |

*Primary Examiner*—John J. Camby

*Attorney, Agent, or Firm*—Knechtel, Valentino, Demeur & Dallas

[57] ABSTRACT

There is disclosed an improved flue box assembly which consists of a housing formed by a continuous sidewall, a top wall and a bottom wall, each of the top wall and bottom wall having an aperture disposed therein, the interior diametric sizing of the housing being substantially greater than both the top wall and bottom wall apertures, and the housing including a damper plate pivotally mounted interioraly thereof and spaced between the top and bottom wall respectively, the damper plate further including a flue opening having a diametric sizing substantially smaller than the top and bottom wall apertures, and the damper plate being constructed and accommodated to be movable between an open position and a closed position, such that when the damper plate is in the closed position, the flue opening is interposed between the top wall aperture and the bottom wall aperture and insures a maximum burning of the fuel in the corresponding furnace, while alternatively, under back pressures or an explosion condition, the damper plate is permitted to move into the full open position and expose the substantially greater diametric sizing of the flue box in order to permit an efficient emission of flue gases from the furnace. The relationship between the various size openings as between the top and bottom wall apertures, the interior diametric sizing of the housing, and the flue opening in the damper plate insures substantially complete combustion of the fuels in the furnace while at the same time accommodating the requirement for a quick, safe and efficient exhaust of flue gases under back pressure or explosive conditions.

7 Claims, 5 Drawing Figures

FIG. 2
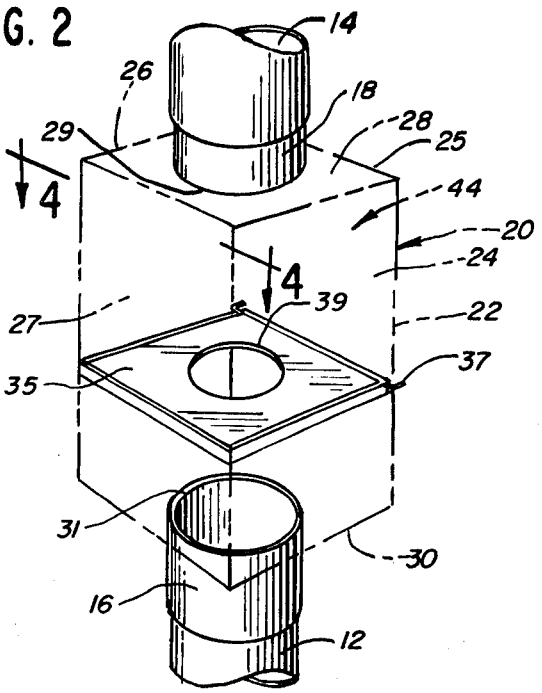
FIG. 1
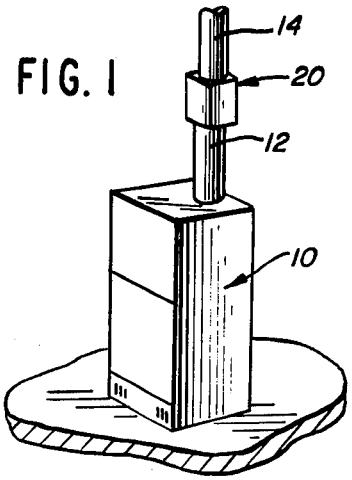
FIG. 4
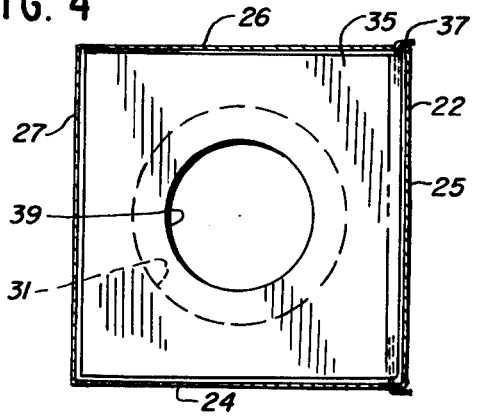
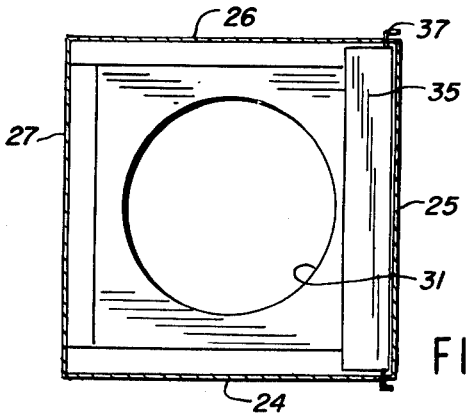
FIG. 5
FIG. 3
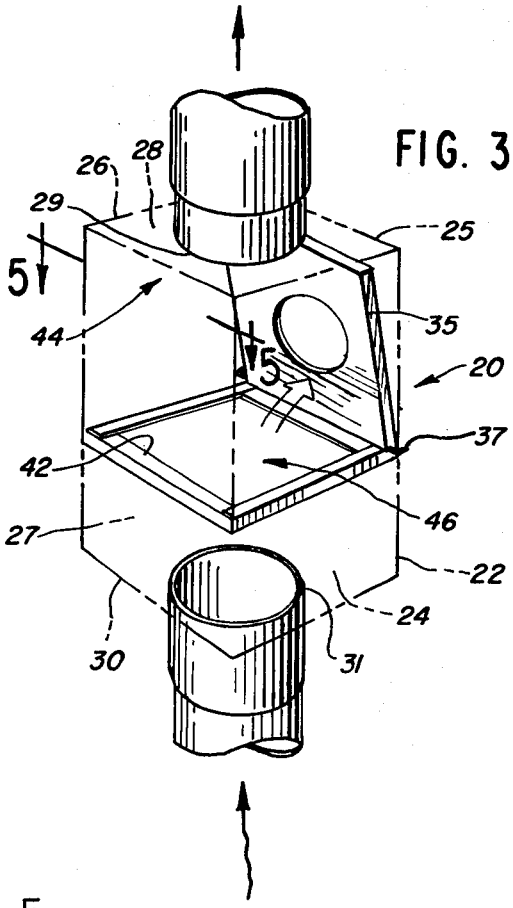

FLUE BOX ASSEMBLY

BACKGROUND OF THE INVENTION

It has become increasingly important to provide the means whereby the various types of fuel presently in existence are conserved to the maximum extent. For example, it has become increasingly known that fuels such as natural gas, oil and the like must be conserved if the current global supply is to provide the needs of the world until alternate sources of fuel or energy sources can be developed. In this connection, various types of devices have been innovated in the last several years with a view toward conserving our natural fuels.

It is now known that the efficiency of various heating plants such as home furnaces and the like, has not been too great for the reason that often, the fuels are not sufficiently burned in the combustion chamber, and hence, the flue waste gases include a fairly large percentage of unburned fuel such as natural gas. It has, therefore, been deemed desirable to develop devices which will retain the natural gases in the combustion chamber or furnace until virtually all of the fuel is combusted such that the flue gases which escape from the furnace are virtually completely waste gases.

Over the years, various types of devices have been developed which have come to accomplish this end, and in fact, it is believed that various of these devices do in fact accomplish this desired end. For example, U.S. Pat. No. 1,196,117 illustrates a damper plate which is employed in the exhaust line of a furnace which consists of a pivotally mounted plate which seats over a sheet metal exhaust tube and is intended to retain the bulk of the exhaust or waste gases within the furnace assembly until they are combusted. It will be noted in connection with this disclosure, that the external perimeter of the sheet metal waste pipe is provided with a plurality of circumferentially disposed recesses in order to permit the escape of some of the flue gases during combustion, while the damper plates insures that the bulk of the gases will remain in the furnace until fully combusted. Similar types of devices are shown in U.S. Pat. No. 1,580,106 which again shows a damper plate which is apertured to permit the exhaust of some of the waste gases during the combustion process, as well as in U.S. Pat. No. 3,912,223, which again shows a pivotally mounted damper plate which closes off the exhaust pipe and retains the gases in the furnace until fully combusted.

The difficulties which have been noted in connection with these types of devices is the fact that during any back pressure or explosive situation, it is necessary that means be provided for waste gases to exhaust themselves from the furnace immediately so that a destructive explosion in the furnace will not occur. It is for this reason that damper plates which are provided along the exhaust pathway of the tubing are providing in a pivotable or otherwise movable fashion. It is intended that during a back pressure or explosive situation, the pivotally mounted damper plate will move to a fully open position and permit the waste gases to be immediately exhaustable from the combustion chamber. The difficulty with the prior art devices is the fact that the diametric sizing of the exhaust pipe immediately above the damper plate has been virtually the same as or less than the diametric sizing of the exhaust pipe immediately below the damper plate. As a result, there is still a danger that the exhaust gases, during a back pressure or explosive situation, cannot be quickly exhausted through the waste pipe, and hence, the danger of an explosive situation with regard to the entire furnace is still present.

OBJECTS AND ADVANTAGES

It is therefore the principal object of the present invention to provide an improved flue box assembly which may be installed in the pathway of the exhaust or waste conduit emanating from a furnace assembly, which will provide a movable damper plate which functions to retain the bulk of the gases within the furnace assembly to insure maximum combustion, while at the same time, being movable to an open position and providing an enlarged chamber during a back pressure or explosive situation such that the waste gases may be quickly and efficiently exhausted from the furnace thereby to minimize the danger of a destructive explosion.

In accordance with the foregoing object, it is a further object of the invention to provide a flue box assembly which includes a housing formed by a continuous sidewall, top wall and bottom wall, with each of the top and bottom walls having an aperture, and including means to accommodate the inner connection to the apertures of an outlet and inlet conduit respectively, the housing having an overall interior diametric opening substantially greater than the diametric opening of either the inlet or the outlet apertures and conduit, and the housing further including damper means spaced a distance below the outlet aperture in the housing and movably positioned within the housing such that the damper means is movable between a closed position overlying the inlet aperture and an open position.

Further to the above object, it is desirable to provide a damper means further including a flue opening sized to be diametrically smaller than each of the inlet and outlet apertures respectively such that the damper means functions to close off a substantial portion of the diametric opening within the housing when in the closed position, and to expose the substantially larger diametric opening of the housing relative to the inlet and outlet apertures respectively, when the damper means is positioned in the completely open position.

In connection with the foregoing object, it is yet a further object of the invention to provide a flue box assembly of the type described wherein the housing is constructed to be interposed in the waste gas outlet emanating from a main furnace box, with the inlet aperture interconnected with the outlet conduit from the furnace, and the outlet aperture of the housing interconnected with an outlet conduit exhausting to atmosphere, wherein the housing assembly has a greater diametric sizing than the diametric sizing of the either the inlet or the outlet conduit connected thereto.

Still a further object of the invention is to provide a flue box assembly of the type described wherein the damper means comprises a damper plate pivotally mounted to the interior of the housing on a sidewall portion thereof such that the damper plate is pivotally movable into a fully opened position under a back pressure condition, and into a closed position extending across the substantially diametric dimensions of the housing in order to substantially close the diametric opening within the housing with the exception of the area bounded by the flue opening contained in the damper plate.

In connection with the foregoing object, it is a further object of the invention to provide a flue box assembly of the type described wherein the housing further includes a peripheral ledge mounted on the interior portions of the sidewall of the housing along a point approximately mid-position between the top and bottom wall portions thereof, and wherein the damper plate is arranged and constructed to rest on the peripheral ledge when in the closed position, the peripheral ledge functioning as a stop means for the damper plate when in the closed position.

Still in connection with the foregoing objects, it is yet a further object of the invention to provide a flue box assembly of the type described wherein the area bounded by the damper plate at the lower end of the top wall at the upper end forms an emission chamber such that when the damper plate is in the closed position, the flue opening forms the inlet opening into the emission chamber and is of a smaller diametric sizing than the outlet aperture in the top wall, and when the damper plate is in the open position, the diametric opening of the housing forms the inlet opening into the emission chamber and is of a greater diametric sizing than the outlet aperture in the top wall, whereby the relationship of pressure and velocity of the waste gases emitted from the furnace during a back pressure or explosive occurrence is compenstated for to insure safe and efficient emission of waste gases when the damper plate is in the open position.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification taken in connection with the accompanying.

BRIEF DESCRIPTION OF THE DRAWINGS

With reference to the accompanying drawings, the following views are depicted.

FIG. 1 is a perspective view showing a representative furnace having the waste gas conduit extending therefrom and the flue box assembly of the present invention depicted in line therewith;

FIG. 2 is a perspective view, partly in cross-section, showing the details of the flue box assembly having the damper means shown in connection therewith, the entire assembly being shown in position between the outlet and inlet conduit respectively;

FIG. 3 is a perspective view, partly in cross-section, showing the damper means formed by a damper plate in the open position, and indicating the relative diametric sizings of the openings as between the furnace outlet, the housing sizing and the waste gas outlet aperture emanating from the emission chamber;

FIG. 4 is a top view taken in the direction of the arrows along the line 4—4 of FIG. 2, partly in cross-section, illustrating the relationship between the damper plate opening and the furnace exhaust opening; and FIG. 5 is a top view taken in the direction of the arrows along the line 5—5 of FIG. 3, and illustrates the relationship between the diametric opening of the housing assembly as compared to the outlet conduit emanating from the furnace box.

SUMMARY OF THE INVENTION

In summary, the present invention provides an improved flue box assembly which is designed to be positioned along the exhaust line emanating from a furnace box, such that the exhaust conduit emanating from the furnace box forms the inlet conduit into the flue box assembly, and wherein the flue box assembly is formed by a housing having a greater diametric sizing than either the waste gas outlet emanating from the furnace, or the outlet conduit emanating outwardly from the flue box assembly. The flue box assembly is formed by a housing which includes a damper plate pivotally mounted therein which is apertured to provide a flue opening, of a smaller diametric sizing than either the inlet or outlet apertures formed in the top and bottom walls thereof, while at the same time being pivotally movable to an open position which thereby exposes an opening of greater dimeatric housing relative to either the inlet or outlet apertures to accommodate a back pressure or explosive occurrence in the furnace box. The flue box assembly of the present invention provides for a more efficient burning of the fuel gases contained in the furnace, while at the same time permitting the safe and efficient and virtually instaneous exhausting of the gases in a back pressure or explosive situation involved in the furnace box.

DETAILED DESCRIPTION OF THE DRAWINGS

As shown in FIG. 1, there is illustrated a typical furnace box 10 which is shown to include a waste gas conduit 12 emanating therefrom. Interposed in the waste gas pathway is the flue box assembly 20 described hereinbelow. Exiting from the flue box assembly 20 is an outlet conduit 14 through which the was gases are emitted from the furnace box through the flue box assembly 20, and out to atmosphere.

With specific reference to FIGS. 2 and 3 of the drawings, the details of construction of the flue box assembly 20 are illustrated in detail. It will be noted that the flue box assembly 20 is formed by a housing 22 which includes a plurality of four sidewalls 24, 25, 26, and 27 respectively, arranged in a continuous fashion such as to completely enclose the housing 22 around the side portions thereof. The housing 22 also includes a top wall 28 and a bottom wall 30, the top wall 28 provided with an outlet aperture 29 and the bottom wall 30 provided with an inlet aperture 31.

While the flue box assembly 20 and specifically the housing 22 thereof, is shown to be basically square or rectangular in configuration, it should be noted that the housing 22 may be in any configuration, such as circular, for example, without detracting from the inventive spirit of the present invention. The criticality resides in the fact that the diametric sizing of the housing 22, at least insofar as the interior dimensions are concerned, is greater than either the outlet aperture 29 or the inlet aperture 31 in the top wall 28 and bottom wall 30 respectively.

As further shown in FIGS. 2 and 3, the housing 22 is shown to be provided with a damper plate 35 which is diametrically sized to fit within the housing 22. As shown therein, the damper plate 35 is pivotally mounted along one of the sidewall portions 25 by means of a pivotal pin 37. The damper plate 35 is also provided with a flue opening 39 which is shown to have a smaller diametric sizing than either the outlet aperture 29 or the inlet aperture 31. It will therefore be appreciated that when the damper plate 35 is in a closed position as depicted in FIG. 2 of the drawings, the waste gases will exhaust from the furnace box through the inlet aperture 31 in the bottom wall 30 of the housing 22, and will further exhaust through the flue opening 39 in the damper plate 35 and exit through the outlet aperture 29 in the top wall 28 of the housing 22. Hence, the damper plate 35 will function to retain the waste gases in the furnace box until complete combustion has been effected.

The flue box assembly 20 is completed by the provision of a peripheral ledge 42 (FIG. 3), which extends peripherally about the interior portion of the sidewalls 24, 25, 26, and 27 respectively, the peripheral ledge functioning as a stop means and rest place for the damper plate 35 when in the closed position as depicted in FIG. 2.

It will further be observed that with the construction of the flue box assembly 20 as described above, the area bounded by the damper plate 35 at the lower end and the top wall 28 of the housing 22 forms an emission chamber generally denoted by the numeral 44. As will be observed from a view of FIGS. 2 through 5 of the drawings, when the damper plate 35 is in the closed position, such that the flue opening 39 is in the path of the waste gas emissions, the waste gases will enter into the emission chamber 44 through the flue opening 39, wherein the pressure and the velocity will decrease as and until the waste gases enter into the outlet aperture 29 and into the outlet conduit 14.

As shown in FIG. 3, when the damper plate 35 is in the open position, there is exposed a greater diametric housing opening, generally denoted by the numeral 46. It will therefore be appreciated that during any back pressure or explosive situation, should there be a sudden rush of waste gases through the waste gas conduit 12 into the flue box assembly 20, the damper plate 25 will be moved by the pressure of the waste gases into the fully open position as shown in FIGS. 3 and 5 respectively, and the greater diametric sizing of the housing opening 46 as well as the sizing of the emission chamber 44 will accommodate the sudden increase in pressure in the waste gas to accommodate virtually all of such types of situations which may arise. The waste gases, will, of course, then commence their exit path of travel through the outlet conduit 14 having the pressure and velocity variables of the waste gas accommodated accordingly such that a safe and efficient emission of the waste gases from the furnace box 10 is provided for by the provision of the flue box assembly 20.

It will be noted that the waste gas conduit 12 and the outlet conduit 14 are accommodated to the flue box assembly 20 by means of the lower collar 16 and an upper collar 18 which permit the friction fitting of the conduits 12 and 14 respectively. It is contemplated that the flue box assembly 2 will be formed of a sheet metal material, and that the collars 16 and 18 respectively, will similarly be formed of sheet metal materials. It is further contemplated that the sizing of the collars will be such as to accommodate standard sized conduits 12 and 14 as are generally found in connectin with furnace boxes 10 such that the flue box assembly 20 may be retrofitted to any existing furnace box 10 presently in existence. It will also be appreciated that in the event that the sizing of the collars 16 and 18 are not proper or sufficient to accommodate a particular furnace box 10, expansion or reduction collars may be employed in order to retrofit the unit to an existing furnace box 10.

As was previously indicated, the actual configuration of the flue box assembly 20 is not particularly relevant with respect to the present invention, the criticality residing in the greater diametric sizing of the interior portion of the housing 22. Hence, from a safety standpoint, the housing 22 may be formed as a cylindrical chamber thereby to eliminate sharp corners in the event that the flue box assembly 20 is to be installed in an area where the user could possibly strike a portion of their body such as their head against the corners of the assembly. The criticality of the subject device resides in the relationship between the respective openings such that the inlet aperture 31 and outlet aperture 29 are sized to be intermediate in sizing as between the flue opening 39 and the damper plate 35, and the housing opening 46 which has for its boundaries, essentially, the interior diametric sizing of the housing 22.

It will be appreciated that in accordance with the present invention, there has been provided an improved flue box assembly which functions to permit a more efficient and substantially complete burning of the furnace fuel when the damper plate is in the closed position, while nevertheless permitting the exiting of waste gases when the damper plate is in the closed position. Simultaneously, the flue box assembly also permits a safe, quick and efficient exhausting of waste gases during a back pressure or explosive situation by permitting the damper plate to open to a fully opened position and exposing a greater diametrically sized opening in the path of the waste gas emissions such that the flue box assembly will virtually accommodate any type of explosive situation which could occur such as where fuel gases are leaking into the system and not being completely combusted. This could occur during a situation where a pilot light is extinguished and the gases are leaking into the system and building to explosive proporations. The pressure of such gases will, in effect, force the damper plate into the open position and permit the gases to exhaust safely and efficiently. It will therefore be noted that the flue box assembly of the present invention accommodates the efficient burning of the fuels involved in any particular furnace arrangement, while at the same time accommodating emergency situations as are routinely found from time to time.

While there has been described what is at present considered to be the preferred embodiments of the invention, it will be understood that various modifications may be made therein and it is intended to cover in the appended claims all such modifications as followed in the true spirit and scope of the invention.

What is claimed is:

1. An improved flue box assembly for installation in conjunction with a heating plant of the type having a heated fluid outlet emanating from the main furnace box and constructed to improve fuel consumption in the heating plant while permitting fast and efficient waste gas emission under severe back pressure situations, comprising in combination, a housing formed by a continuous sidewall, a top wall and a bottom wall, each of said top wall and bottom wall having an aperture, means associated with each of said top and bottom apertures for accommodating the interconnection thereto of an outlet and inlet conduit respectively, said housing having an interior diametric opening substantially greater than the diametric opening of said inlet and outlet apertures respectively, said housing further including damper means spaced a distance below said outlet aperture in said housing and movably positioned within said housing such that said damper means is movable between a closed position overlying said inlet aperture and an open position, said damper means further including a flue opening sized to be diametrically smaller than each of said inlet and outlet apertures such that said damper means functions to close off a substantial portion of the diametric opening within said housing when in the closed position and to expose a substantially larger diametric opening relative to said inlet and outlet apertures when in the open position, whereby said flue box assembly, when installed in the fluid pathway of the heated fluid outlet emanating from the main furnace box functions to retain the furnace fuel within the furnace until the fuel is substantially burned when said damper means is in the closed position and permitting only waste gases to be emitted through said diametrically smaller flue opening in said damper means, while at the same time permitting a fast and efficient emission of waste gases in the event of any back pressure or minor explosions within the furnace by having said damper means movable to an open position which thereby exposes said substantially greater diametric opening of said housing relative to said inlet and outlet aperture thereby to provide an assembly which permits efficient and substantially complete burning of the fuel within the furnace while at the same time an efficiently safe assembly in the event of back pressure or explosion situations.

2. The improved flue box assembly as set forth in claim 1, wherein said housing is substantially square in configuration, and said inlet conduit interconnects with said bottom wall aperture and said outlet conduit interconnects with said top wall aperture, whereby said flue box assembly is interposed in a fluid outlet emanating from the main furnace box.

3. The flue box assembly as set forth in claim 2 above, wherein said means for interconnection of said outlet and inlet conduits respectively comprises a collar mounted on the exterior surface of said top wall and said bottom wall respectively, and accommodating the friction fit of the respective outlet and inlet conduit.

4. The flue box assembly as set forth in claim 1 above, wherein said damper means comprises a damper plate pivotally mounted to the interior of said housing along a sidewall portion thereof, whereby said damper plate is pivotally movable into an open position under a back pressure condition, and into a closed position extending across the diametric dimensions of said housing thereby to substantially close the diametric opening within said housing with the exception of the area bounded by said flue opening.

5. The flue box assembly as set forth in claim 4 above, wherein said damper plate is interposed substantially between said top wall aperture and said bottom wall aperture.

6. The flue box assembly as set forth in claim 5 above, wherein said housing further includes a peripheral ledge mounted on the interior of said sidewall of said housing and said damper plate is arranged and constructed to rest on said peripheral ledge when in the closed position, said peripheral ledge functioning as a stop means for said damper plate when in the closed position.

7. The flue box assembly as set forth in claim 6 above, wherein the area bounded by said damper plate at the lower end and said top wall at the upper end forms an emission chamber such that when said damper plate is in the closed position, the flue opening forms the inlet opening in the said emission chamber and is of a smaller diametric sizing than the outlet aperture in said top wall, and when said damper plate is in the open position, the diametric opening of said housing forms said inlet opening into said emission chamber and is of a greater diametric sizing than said outlet aperture in said top wall, whereby the relationship of pressure and velocity of the waste gases emitted from the furnace during a back pressure occurence is compensated for to insure efficient emission of waste gases when the damper plate is in the open position.

* * * * *